US006095076A

United States Patent [19]

Nesbitt

[11] Patent Number: 6,095,076

[45] Date of Patent: Aug. 1, 2000

[54] HYDROFOIL BOAT

[76] Inventor: Glenn Scott Nesbitt, P.O. Box 12731, Santa Barbara, Calif. 93107

[21] Appl. No.: 09/172,983

[22] Filed: Oct. 14, 1998

Related U.S. Application Data

[60] Provisional application No. 60/062,385, Oct. 20, 1997, and provisional application No. 60/062,394, Oct. 14, 1997.

[51] Int. Cl.[7] ..... B63B 1/24

[52] U.S. Cl. ..... 114/279; 114/274; 114/283

[58] Field of Search ..... 114/279, 274, 114/280, 276, 278, 282, 283, 271, 281, 126

[56] References Cited

U.S. PATENT DOCUMENTS

| | | | |
|---|---|---|---|
| 4,159,690 | 7/1979 | Farris | 114/275 |
| 4,208,980 | 6/1980 | Henkel | 114/274 |
| 4,349,340 | 9/1982 | Hoffmann | 114/282 |
| 4,356,786 | 11/1982 | Tuggle | 114/280 |
| 4,955,312 | 9/1990 | Maguzzu' | 114/280 |
| 4,964,357 | 10/1990 | Genfan | 114/274 |
| 5,469,801 | 11/1995 | Payne | 114/282 |
| 5,653,189 | 8/1997 | Payne | 114/274 |

*Primary Examiner*—S. Joseph Morano
*Assistant Examiner*—Lars A. Olson
*Attorney, Agent, or Firm*—Michael G. Petit

[57] ABSTRACT

A hydrofoil marine vehicle having separate forward and rearward hydrofoil wings connected by a center beam. The generally V-shaped hydrofoil wings are affixed to the center beam at either end by means of flexibly mounted struts. The center beam supports a passenger cabin or pod which may also include a gyroscopic element. In one embodiment of the marine vehicle, the pod, which is hydraulically suspended above the center beam, houses a gyroscope which is approximately 4–10 feet in diameter and weighs about 100–500 pounds. The gyroscope acts as a pod stabilizer and energy absorbing mechanism. Static flotation for the marine vehicle is provided by the passenger pod. At slow forward speeds, the hydrofoils are submerged and the upper curved surfaces of the hydrofoils generate the lift required to bring the hydrofoils to the surface of the water. The gyroscope mitigates the pounding effect on the pod which occurs when the hydrofoils skip across the surface of the water at higher speeds and helps stabilize the side-to-side movement of the pod when the craft encounters wave or swell activity.

7 Claims, 5 Drawing Sheets

HYDROFOIL BOAT

This Application claims benefit of Provisional Application No. 60/062,385, filed Oct. 20, 1997, and Provisional Application No. 60/062,394, filed Oct. 14, 1997.

BACKGROUND OF THE INVENTION

1. Field of the Invention

This invention generally relates to hydrofoil marine vehicles and more particularly to a gyroscopically stabilized hydrofoil marine vehicle.

2. Prior Art

Conventional hydrofoil marine vehicles are boats which possess a planing hull and have one or more support struts extending downwardly from beneath the hull into the water. One or more hydrofoils for supporting the hull are connected to the lower ends of the support struts. When the hydrofoil marine craft has accelerated to a sufficient velocity through the water, the lift created by the hydrofoils raises the craft's hull above the water surface thereby eliminating the hull's resistance.

It is well known that conventional hydrofoil crafts having totally immersed hydrofoils have drawbacks including a difficulty reducing speed without undue sinking or increasing speed to the point that cavitation adjacent to the upper surface of the hydrofoil damages or destroys the hydrofoils. Another problem is that conventional hydrofoil marine craft have their hydrofoils connected to the hull of the craft by supporting struts which are rigidly attached to the hull. As a result, all of the vertical acceleration imparted to the hydrofoils is also imparted to the hull. This problem becomes most significant at high speed or in choppy water.

The problems associated with cavitation around a hydrofoil at high speeds has received considerable attention in the patent literature. In particular, Payne, in U.S. Pat. No. 5,653,189 discloses a means for reducing cavitation on the anterior aspect of a hydrofoil by means of a layer of air pumped over the foil to reduce the pressure thereon. Other patents addressing problems encountered in hydrofoil marine vehicles include U.S. Pat. Nos. 4,964,357; 4,955,312; 4,349,340; 5,469,801; 4,356,786 and 4,208,980. The prior art also reveals the use of a gyroscopic sensor element to stabilize a hydrofoil craft as set forth in U.S. Pat. No. 4,159,690 to Farris.

SUMMARY OF THE INVENTION

It is an object of the present invention to provide a hydrofoil marine vehicle which can comfortably operate at moderate to high speed.

It is another object of the present invention to provide a hydrofoil marine vehicle which can efficiently employ a gyroscope for assisted stabilization.

It is yet a further object of the invention to provide a hydrofoil marine vehicle having dynamic dampening capability responsive to prevailing water conditions without active control, logic response systems or sensors.

The above objectives are met with a marine vehicle having planing hydrofoil wings which offer the characteristics of a low drag-to-mass ratio when compared to hulled marine vehicles. The advantages include the ability to pierce oncoming surface waves with low drag resistance in contrast to the "collision-like" resistance characteristic with surface waves as occurs with traditional hulled water craft and marine vehicles. The present invention marine vehicle incorporates a dynamic dampening system to control surface induced vibration and rough water conditions with respect to passengers.

A preferred embodiment of the present invention is a gyroscopically stabilized marine vehicle having separate fore and aft hydrofoil wings which are connected by a center beam. Each hydrofoil wing is supported by a single flexible vertical strut which extends upward from the hydrofoil wing to the center beam. The center beam supports either a water-tight or open, substantially centered pod providing "helicopter-style" seating for the driver and passenger(s). The pod is hydraulically suspended above or rigidly attached to the center beam and may house a gyroscope. The gyroscope comprises a solid rotatably mounted element having a generally disk shape, approximately 4–10 feet in diameter with a mass of approximately 10% of the pod mass (or 100–500 pounds). The gyroscope acts as a pod and craft stabilizer and energy absorbing assembly.

The marine vehicle of the present invention derives its static floatation by virtue of the passenger pod. The bottom surface of the pod resembles and has the displacement properties of a small boat. The hydrofoil profile is substantially flat on its bottom surface and curved on its upper surface similar to the wing design employed by the aircraft industry. At slow speeds, when the hydrofoils are entirely submerged, the upper curved surfaces generate the lift required to bring the hydrofoils to the surface of the water. Each of the fore and aft hydrofoil wings are "v"-shaped and swept backwards to prevent the collection of debris on the leading edges thereof and to increase active stability and reduce the drag co-efficient in relation to the mass of water as the vehicle travels in a forward direction. The two downwardly depending struts to which the hydrofoils are attached are flexibly mounted on the center beam and positioned on either end thereof and forward and aft of the pod, respectively. The hydrofoils have an upward facing wing tip to guide the vehicle during both slow and high speeds. At high speeds the ends of the wings are fully wetted about 70% of the time. The pod suspension assembly (which mounts the pod to substantially the center of the center beam) adds an energy absorbing buffer between the hydrofoils and the passenger pod. The primary purpose of the gyroscope is to mitigate the pounding effect on the pod created in the event that the hydrofoils skip across the surface of the water. Secondarily, the gyroscope helps to stabilize the passenger section when the marine craft encounters rough wave or swell activity.

The features of the invention believed to be novel are set forth with particularity in the appended claims. However the invention itself, both as to organization and method of operation, together with further objects and advantages thereof may be best be understood by reference to the following description taken in conjunction with the accompanying drawings in which:

DESCRIPTION OF THE PREFERRED EMBODIMENTS

Figure 1:
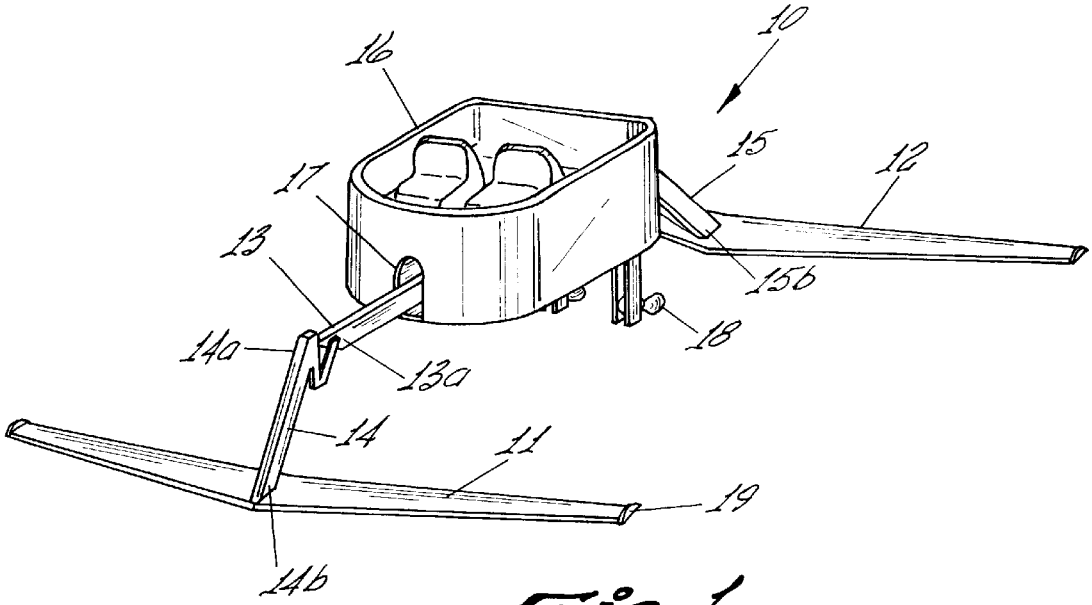
FIG. 1 is front perspective view of a hydrofoil marine vehicle in accordance with the present invention.
Figure 2:
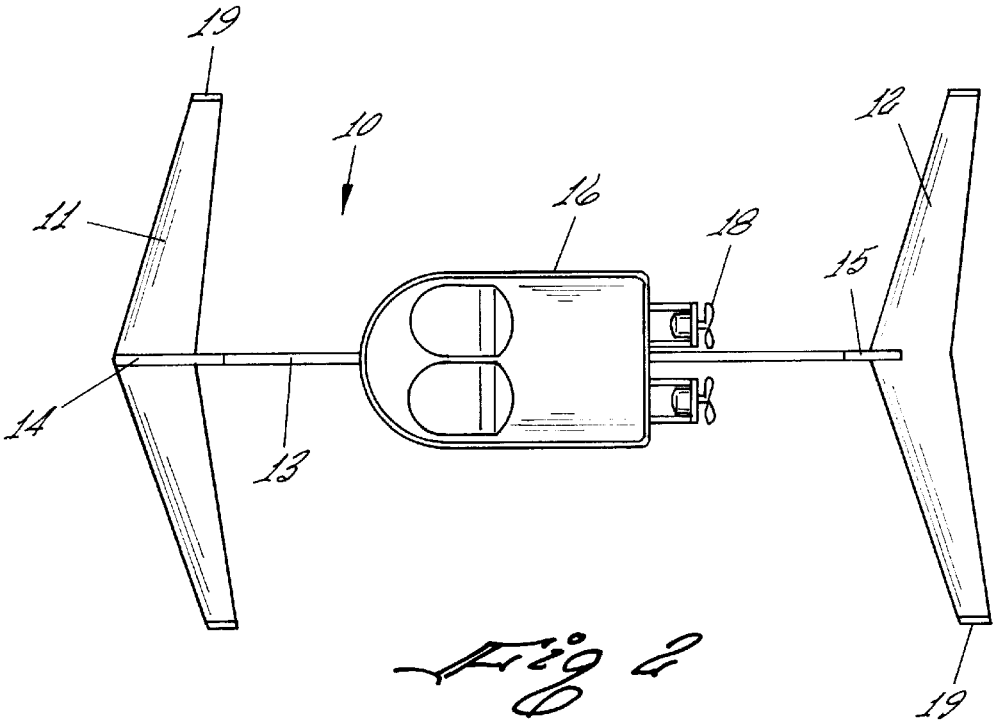
FIG. 2 is a top plan view of the marine hydrofoil craft in accordance with the present invention.

Turning first to FIG. 1, a hydrofoil marine vehicle 10 having separate forward 11 and rearward 12 hydrofoil wings which are connected by a center beam 13. The generally v-shaped hydrofoil wings 11 and 12 are affixed the center beam 13 at either end thereof by means of flexibly mounted forward and rearward struts 14 and 15 respectively. The center beam 13 supports a passenger pod 16. The pod 16, which is hydraulically suspended above the center beam 13 may, as shown an embodiment to be discussed below further, include a gyroscope. The gyroscope acts as a pod stabilizer and energy absorbing mechanism. Static flotation for the marine vehicle 10 is provided by the passenger pod 16. In operation at forward speed, the hydrofoils 11 and 12 are submerged and the upper curved surface of the hydrofoils generate lift required to bring the hydrofoils to the surface of the water. A top plan view of the hydrofoil marine vehicle 10 of FIG. 1 is shown in FIG. 2.

The marine hydrofoil craft includes a center beam 13 and forward 14 and rearward 15 supporting struts supported by the hydrofoils and, when at rest, the pod. A front rotation slot 17 in the forward portion of the pod enables the center beam 13 to rotate about an axis extending transversely with respect to the center beam. The forward hydrofoil 11 is rotatably attached to the lower end of the forward support strut 14 for supporting the forward end 13*a* of the center beam and pod above the water surface. The hydrofoil wing can move in angular relationship with respect to the center beam orientation in concert with up thrusts and down thrusts of water surrounding the foil thereby reducing acceleration imparted to the center beam and therefore the pod. The two support struts 14 and 15 are attached to the center beam 13, at the forward 13*a* and rearward 13*b* ends of the center beam 13 respectively. The support struts 14 and 15 extend downward from the center beam into the water. Preferably the support struts 14 and 15 extend angularly downward from the center beam into the water as shown in FIG. 1. While attachment of upper end of each support strut to the center beam may be either pivotal or rigid, a pivotal connection is most desirable. If the attachment is rigid, the support struts should be at least partially flexible. If the attachment is pivotal, the upper end of each support strut, and preferably the entire support struts are substantially rigid.

Figure 3A:
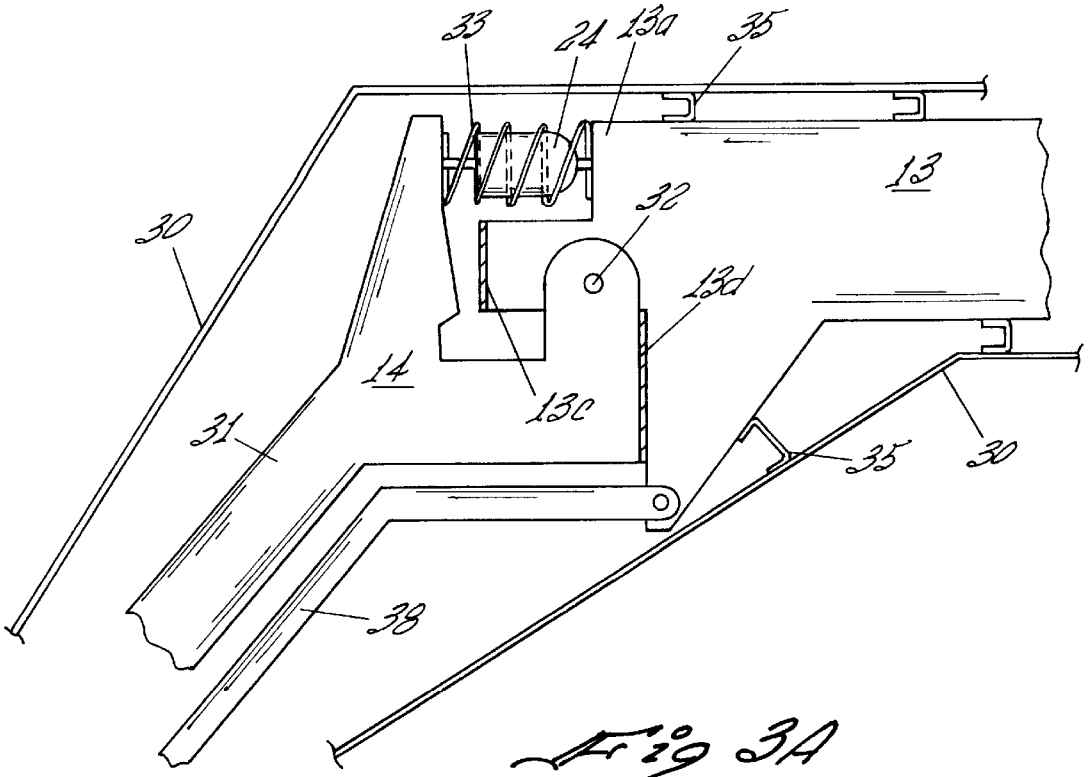
FIG. 3*a* is a schematic elevational view showing the inter-connection between the forward end of the center beam and the upper end of the forward strut.
Figure 3B:
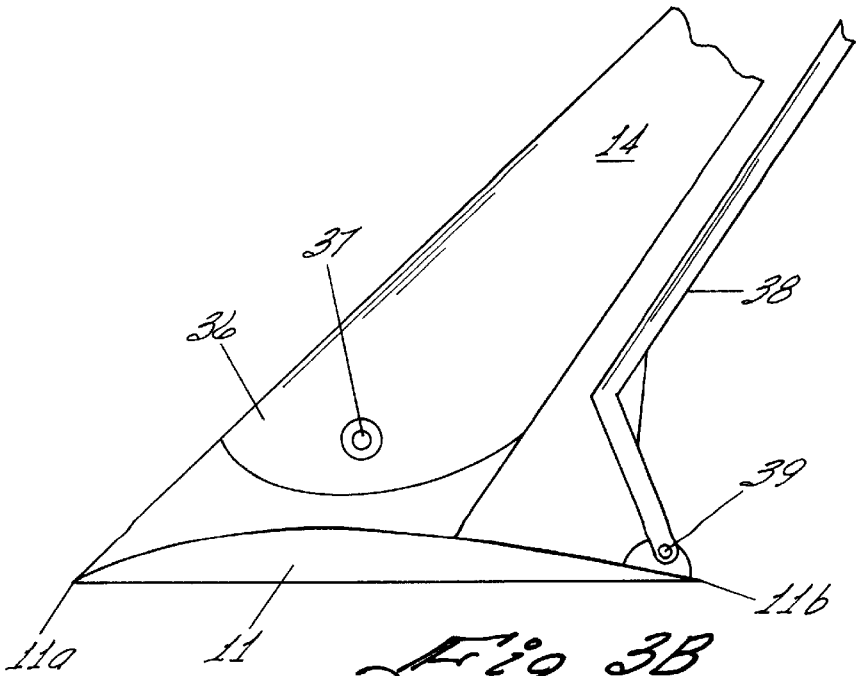
FIG. 3*b* is a schematic diagram showing the inter-connection between the hydrofoil wing and the lower end of the forward strut.

With reference now to FIGS. 3*a* and 3*b*, the forward support strut 14 is shown in inter-connection with the forward end 13*a* center beam 13 and the forward hydrofoil wing 11, respectively. Turning first to FIG. 3*a*, the center beam 13 has a pivotal connection 32 with the upper end 31 of the support strut 14. A coil spring 33 and shock absorber 34 are interposed between the movable portions the strut 14 and center beam 13 to provide shock absorption. The attachment between the center beam 13 and the upper end of the strut 14 is housed within a plastic shroud 30 separated from the center beam 13 by spacers 35. The arrangement of the attachment of the center beam 13 to the upper end 31 of the strut 14 permits flexible pivotal motion of the strut 14 with respect to the center beam 13 around pivot point 32. Elastically deformable stops are shown at 13*c* and 13*d*.

Turning next to FIG. 3*b*, the lower end 36 of the forward strut 14 is rotatably attached to the hydrofoil wing 11 by rotatable attachment means 37 such as a pin. A tie rod 38 extends between the center beam 13 and the rearward 11*b* edge of the hydrofoil wing 11. The forward edge 11*a* of the hydrofoil wing 11 is rotatably mounted on the lower end 36 of the support strut 14 pivotal mounting means 37 such as a pin.

Figure 4A:
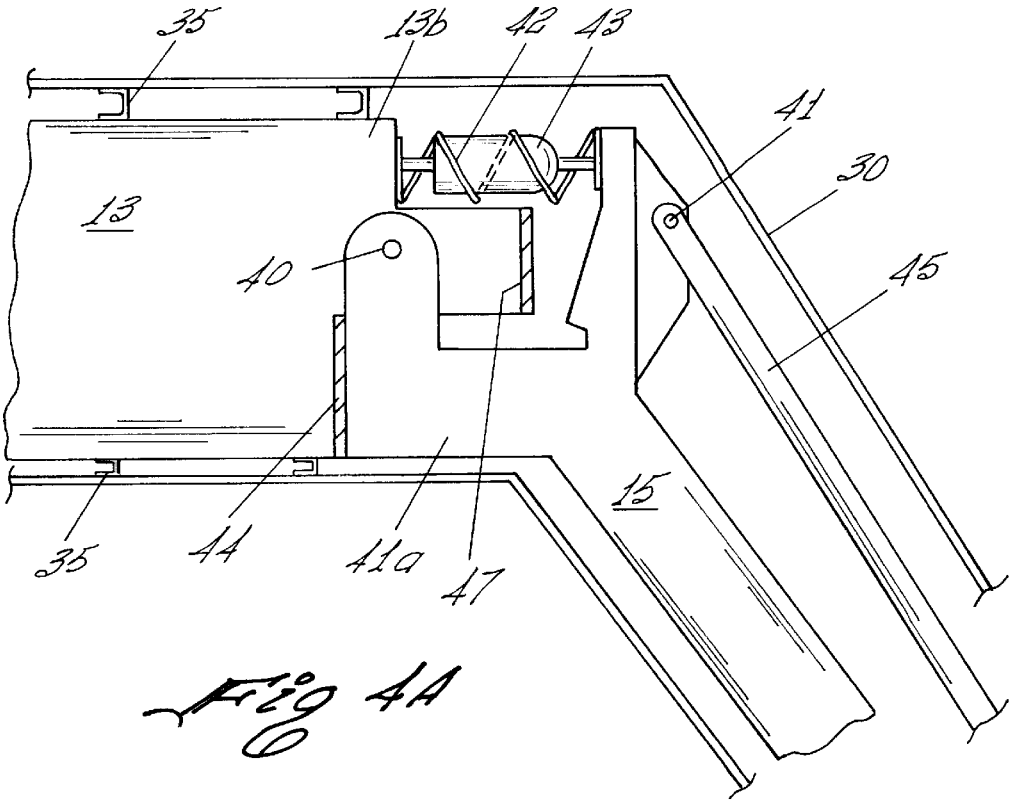
FIG. 4*a* is an elevational schematic diagram showing the inter-connection between the rearward portion of the center beam and the upper end of the rearward strut.

In FIG. 4*a*, the upper end 41*a* of the rearward strut 15 is shown at its point of attachment to the rearward end 13*b* of the center beam 13. The point of attachment 40 of the upper end 41*a* of the rearward strut 15 to the rearward end 13*b* of the center beam 13 is a pivotal mounting. A tie rod 45 is rotatably attached to the rearward end 13*b* of the center beam 13 by means of a second pivotal mounting 41. Spacers 35 separate the plastic shroud 30 from the center beam. A shock absorber 43 and coil spring 42 are interposed between the rearward end 13*b* of the center beam 13 and the upper end 41*a* of the rearward strut 15.

Figure 4B:
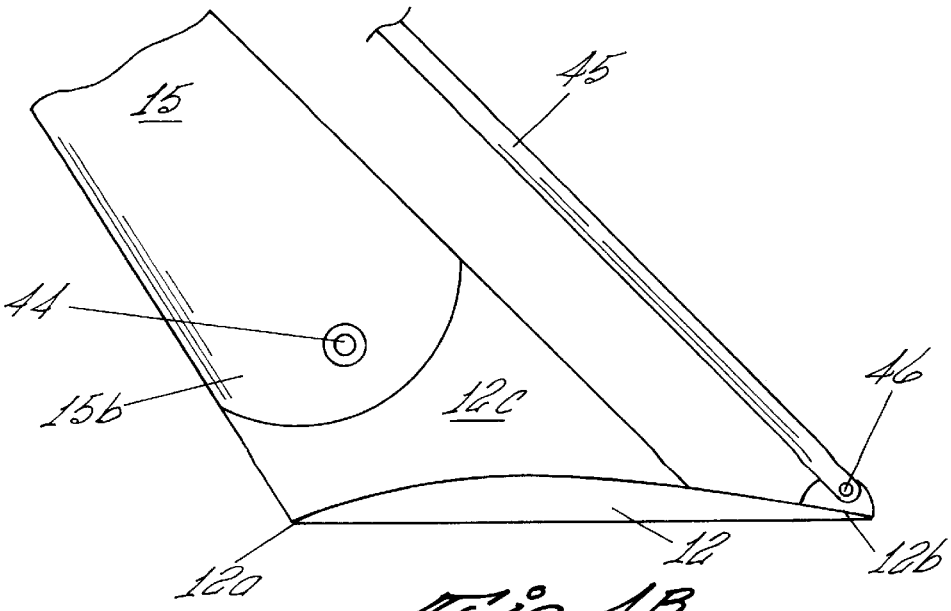
FIG. 4*b* is an elevational schematic view showing the inter-connection between the hydrofoil and the lower end of the rearward support strut.

In FIG. 4*b*, the lower end 15*b* of rearward strut 15 is shown rotatably attached to the rearward hydrofoil wing 12 by a rotatable mounting means 44. The lower end of the tie rod 45 is rotatably mounted to the rearward end 12*b* of the rearward hydrofoil wing 12 by rotatable mounting means 46. The upper and lower rotatable mounting means connecting the rear strut to the center beam 13 and the hydrofoil wings 12 enable the hydrofoil wing 12 to maintain its stable position within the water environment even during periods of up thrusts or down thrusts of the water with respect to the hydrofoil wing 12. The shock absorber and spring assemblies 42 and 43 provide greater comfort to the passenger and improved stability of the device.

Figure 5:
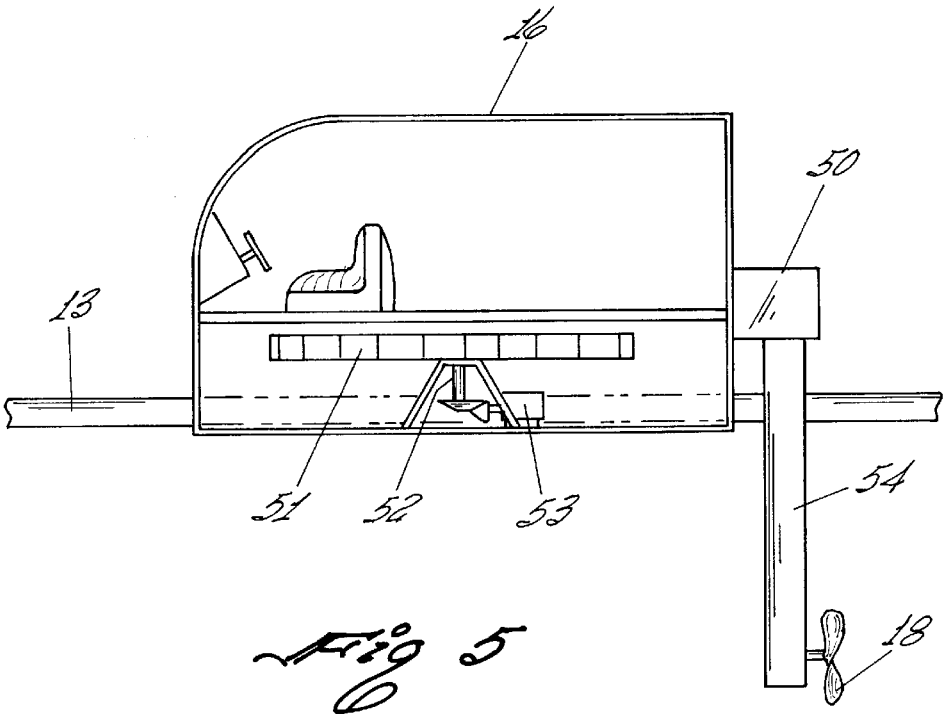
FIG. 5 an elevational view showing the structural relationship between the pod and the center beam.
Figure 6:
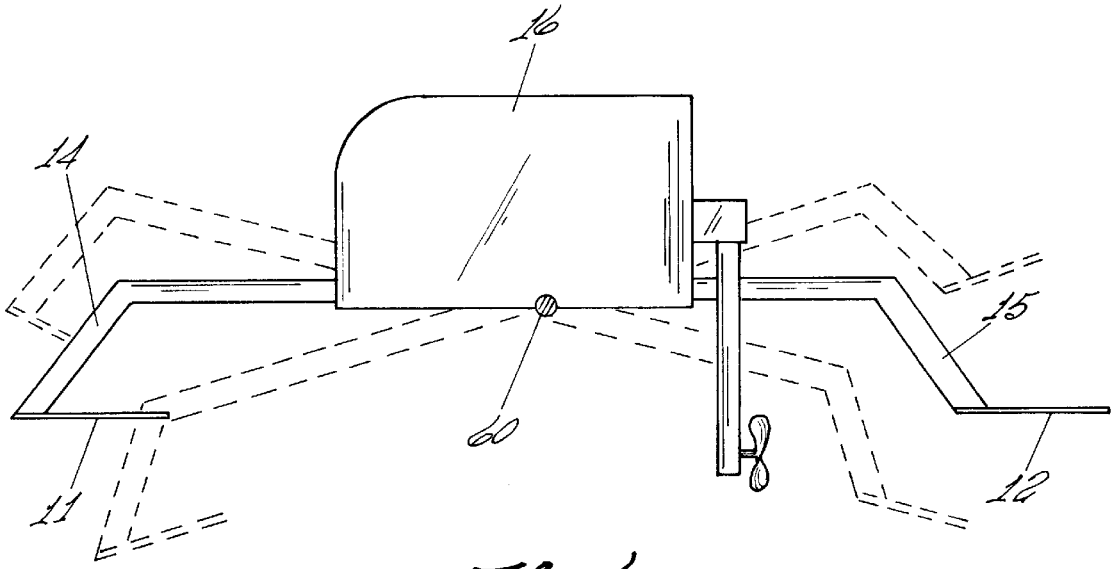
FIG. 6 is a horizontal plan view showing the relative range of displacement between the center beam and the pod.

An elevational, partially schematic view of the portion of the marine vehicle bearing the pod is shown in FIG. 5. The pod 16 is suspended above the center beam 13 by hydraulic and/or rotational means (not shown). In this embodiment of the hydrofoil marine vehicle a gyroscopic disc 51 is mounted to rotate within the pod on an axle 52. The axle 52 derives is rotational power from a auxiliary power source 53 or by a transfer box (not shown) from a main power source 50. The power source 50 may be an outboard motor which is attached to the pod to drive a propeller 18 by means of a drive shaft 54. The power source 50 provides power for propelling the marine craft through the water. The power source 50 may be a pair of outboard engines either mounted on the center beam or on the pod. The purpose of the rotating gyroscopic member 51 in this embodiment is to provide stability to the pod 16 when the forward and rearward ends of the center beam 13 are vertically displaced by differential water up thrusts. The pod is maintained in a stable position and the center beam rotates about a rotational attachment means 60 which rotationally affixes the pod 16 to the center beam 13 as shown in FIG. 6. The combination of hydraulic mounting of the pod, the gyroscopic member, rotational mount 60 and shock absorption by the struts provide a stable and relatively smooth ride to passengers within the pod 16.

Figure 7:
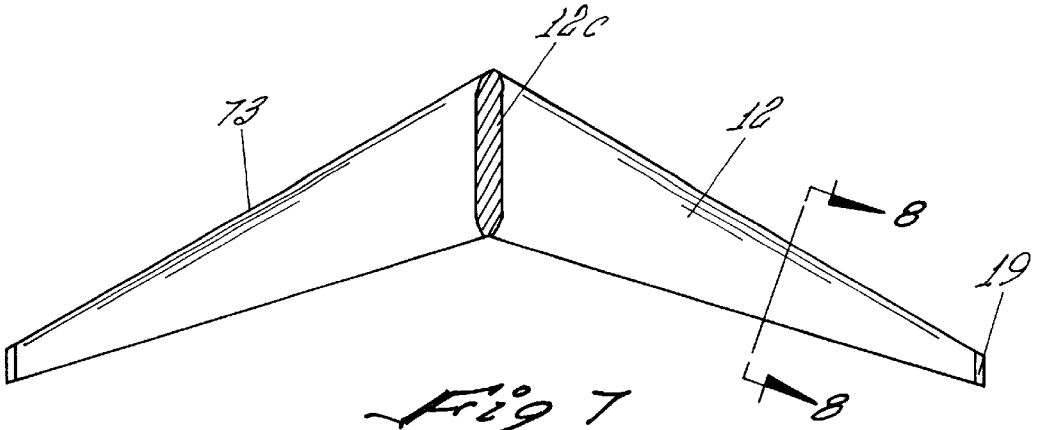
FIG. 7 is a top plan view of the hydrofoil wing assembly, which is substantially the same for both front and rear, hydrofoil wings in accordance with the present invention.
Figure 8:
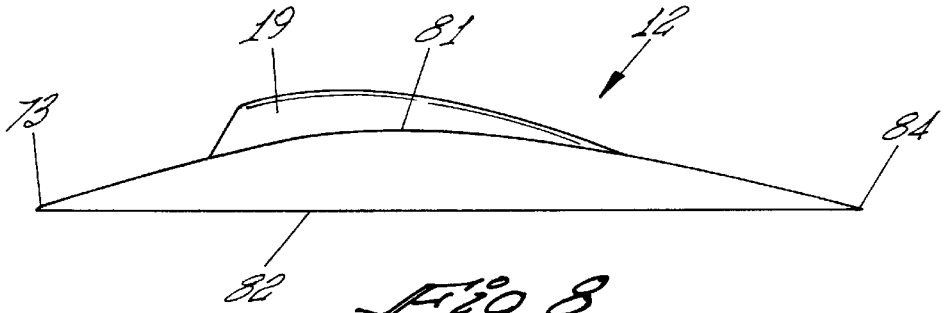
FIG. 8 is a cross-sectional view taken along section line 8—8 of FIG. 7 showing a cross sectional portion of the hydrofoil wing.
Figure 9:
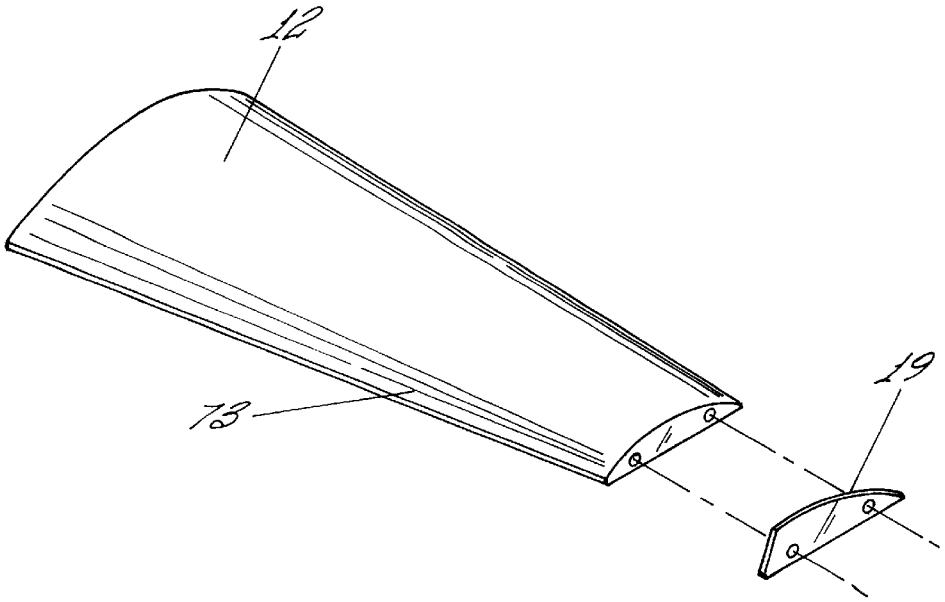
FIG. 9 is an exploded perspective substantially end-on view of a portion of the hydrofoil wing showing the wing tip in accordance with the present invention.

The hydrofoil wings 12 in accordance with the present invention are shown in detail in FIGS. 7 through 9. In FIG. 7, the rear hydrofoil wing 12 is shown in top plan view. The hydrofoil wing 12 has a center portion 12*c* which in integral therewith and symmetrically separates the left and right portions of the hydrofoil wing. The center portion 12*c* is rotatably attached to the lower end of the rearward strut as shown in FIG. 4*b*, and tie rod 45. This rotational assembly permits the hydrofoil wing to remain stable in turbulent waters.

A cross-sectional view of the hydrofoil wing 12 along section line 8—8 (FIG. 7) is shown in FIG. 8. The leading edge 73 of the wing and the trailing edge of the wing 84 are connected by a flat lower section 82. The upper section 81 of the hydrofoil wing is curved to provide hydrodynamic lift when the foil is traveling in the direction of 73. The wing tip 19 is shown as extending above the profile of the hydrofoil wing 12. This wing tip 19 serves as a fin and stabilizes the marine craft when it is necessary to turn. The relationship between the wing tip 19 and the hydrofoil wing 12 is shown in more detail in FIG. 9. The section of the hydrofoil wing forming the tip 19 is enlarged in profile so as to dig into the water and prevent sideways slippage during a turn.

A "V" shaped hydrofoil wing can be viewed as a surface comprising a plane which is inclined away from the direction in which the marine vehicle is moving. If one views the center leading point of the "V" shape as the point having coordinates (0,0,0) in three dimensions, the two wing tips when viewed from behind along the positive y-axis at (0,Y,0)), the left wing tip would be at (X,Y,−Z) and the right wing tip is located at (−X,Y,−Z). A side view of the hydrofoil reveal that the tips are slightly lower than the leading point of the "V" shape. At slower speeds the greater forces exerted on the hydrofoil wings by the water are at the point (0,0,0), and at higher speeds the greater forces exerted on the hydrofoil wings are at (X,Y,−Z and (−X,Y,−Z). This means that at higher speeds the marine vehicle will be planing on four, all at the near extremities of the marine vehicle. This dynamic support arrangement translates into overall superior stability, handling, lowered drag between the body of water and the marine vehicle, and improved safety characteristics.

One advantage of wave piercing hydrofoils at high speeds, when compared to a traditional watercraft mono-hull, is safety. When a traditional watercraft mono-hull encounters a cresting wave approximately three to six or more feet in height, the traditional watercraft mono-hull may be lifted above the surface of the water, similar to the ramping effect water skiers may experience when using a ramp for jumping. The hull becomes airborne with unpredictable results which may then lead to a complete airborne rotation due to the relatively large hull surface acting, temporarily, as an airfoil at speeds approximately 80 mph or more. In contrast, wave piercing characteristics of the present design which cuts a relatively level path through the water wave. In addition the vertically adjustable strut assembly mounted to the center beam dampens shock. The hydrofoil wave piercing design rises to the surface of the body of water and thus avoids the ramping and subsequently unpredictable airborne effecting experienced by a traditional watercraft hull moving in a forward direction at moderate to high speeds.

The leading edges of the forward and rearward vertical adjustable struts are vertically beveled to a centered edge to direct water laterally and avoid an upward planing of water and spray over and onto the passenger pod. Tapering the leading edge of the forward strut prevents spray which may contribute to poor driver and passenger visibility.

Previous hydrofoil watercraft designs are "fully wetted", meaning the hydrofoil operates under the surface of the water and requires a sophisticated active control system to maintain the desired distance between the bottom of the hull and the water surface, and to keep the watercraft in an upright vertical position with respect to the earth while traveling in a forward direction. This is due to the fact that forces acting on the hydrofoil wing (or wings) are relatively equal above and below the surfaces of the hydrofoils, when compared to a vehicle design wherein the hydrofoils operate in the boundary layer between the water (a dense liquid) and the air (a less dense liquid). The dense liquid or water exerts the greater forces on the hydrofoil resulting in the hydrofoil wing operating at the surface of the water. At forward speeds the hydrofoil wing is inclined with relation to the surface of the water. All the above contributes to a simplification of the necessary controls which combine to keep a hydrofoil level with the surface of the water which, in turn, orients the overall marine vehicle level with the surface of the water. All of these features when taken together, contribute to the reduction in complexity (in relation to the fully wetted hydrofoil design) and increases overall marine vehicle stability, inherent safety, and fuel efficiency due to the low drag mass ratio characteristics of the hydrofoils.

The hydrofoil wings and adjustable strut assemblies may also be adapted to aircraft to improve the survivability of a high speed landing or high speed crash landing. Additionally, a possible fixed design for a water landing aircraft may incorporate a hull-like body for static flotation and incorporate a fixed configuration hydrofoil wing or wings and such strut assembles for high speed take-off and landings.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What I claim is:

1. A hydrofoil marine vehicle comprising:

(a) a center beam having a forward end and a rearward end and a center midway therebetween;

(b) a downwardly depending forward strut having an upper end and a lower end, said upper end being movably affixed to said forward end of said center beam;

(c) a forward hydrofoil affixed to said lower end of said forward strut;

(d) a downwardly depending rearward strut having an upper end and a lower end, said upper end being movably affixed to said rearward end of said center beam;

(e) a rearward hydrofoil affixed to said lower end of said rearward strut;

(f) a passenger pod mounted substantially on said center of said center beam by vibrationally-isolating mounting means; and (g) power means operable for propelling said marine vehicle through water.

2. The hydrofoil marine vehicle of claim 1 wherein said passenger pod further comprises a rotatably mounted gyroscopic assembly.

3. The hydrofoil marine vehicle of claim 2 wherein said gyroscope assembly derives rotational energy from said power means.

4. The hydrofoil marine vehicle of claim 1 further comprising vibration absorbing mounting means disposed between said forward end of said center beam and said upper end of said forward strut.

5. The hydrofoil marine vehicle of claim 4 further comprising vibration absorbing mounting means disposed between said rearward end of said center beam and said upper end of said rearward strut.

6. The hydrofoil marine vehicle of claim 1 wherein said center beam is rotatably mounted with respect to said pod.

7. The hydrofoil marine vehicle of claim 1 wherein said forward and rearward hydrofoil wing further comprise vertically oriented tips thereon, said tips lying in a plane substantially orthogonal to the plane of the hydrofoil wing.

* * * * *